US005647511A

United States Patent [19]

Bond

[11] Patent Number: 5,647,511

[45] Date of Patent: Jul. 15, 1997

[54] COLLAPSED BAG WITH EVACUATION CHANNEL FORM UNIT

[75] Inventor: Curtis J. Bond, Worthington, Ohio

[73] Assignee: Liqui-Box Corporation, Worthington, Ohio

[21] Appl. No.: 594,761

[22] Filed: Mar. 29, 1984

[51] Int. Cl.[6] ..... B65D 35/08; B65D 35/56

[52] U.S. Cl. ..... 222/105; 222/107; 222/183; 222/464.2; 222/464.3; 494/213; 494/929

[58] Field of Search ..... 222/92, 105, 386.5, 222/464, 83, 566, 464.1, 464.2, 464.3, 107; 493/213, 929; 383/33, 37, 46

[56] References Cited

U.S. PATENT DOCUMENTS

| | | | |
|---|---|---|---|
| 2,569,975 | 10/1951 | Cone . | |
| 2,920,798 | 1/1960 | Samuels . | |
| 3,081,911 | 3/1963 | Scholle | 222/107 |
| 4,087,026 | 5/1978 | Petterson | 222/386.5 |
| 4,137,930 | 2/1979 | Scholle | 137/68 R |
| 4,138,036 | 2/1979 | Bond | 222/105 |
| 4,148,416 | 4/1979 | Gunn-Smith | 222/94 |
| 4,286,636 | 9/1981 | Credle | 141/114 |
| 4,445,550 | 5/1984 | Davis et al. | 141/329 |
| 4,524,458 | 6/1985 | Pongrass et al. | 383/33 |

FOREIGN PATENT DOCUMENTS

| | | | |
|---|---|---|---|
| 600684 | 6/1960 | Canada | 222/92 |
| 1473524 | 5/1977 | United Kingdom . | |
| WO83/01605 | 5/1983 | WIPO . | |

*Primary Examiner*—Kevin R. Shaver
*Attorney, Agent, or Firm*—Kremblas, Foster, Millard & Pollick; Sidney W. Millard

[57] ABSTRACT

A substantially flat collapsed plastic bag with an evacuation form unit insert positioned therein as manufactured to serve as a form about which the filled bag will collapse as it is emptied. The form unit comprises a ring for mounting the unit on the spout of the bag and a multi-channel form extending radially from the ring and hingedly connected thereto. A simple method is provided for manufacturing the bag with the form unit insert.

27 Claims, 6 Drawing Sheets

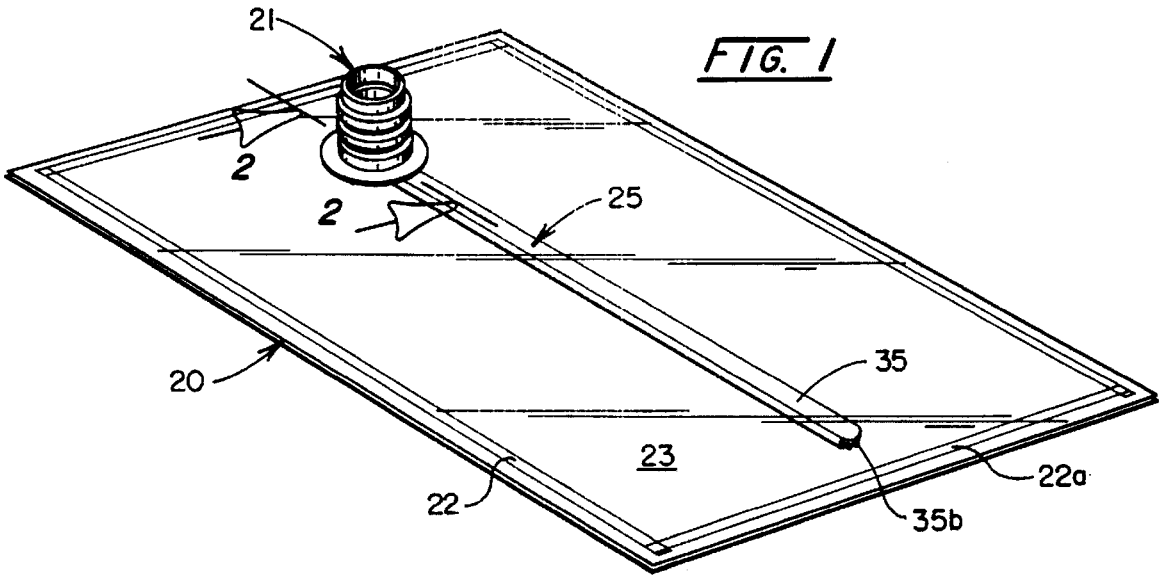
FIG. 1
FIG. 2
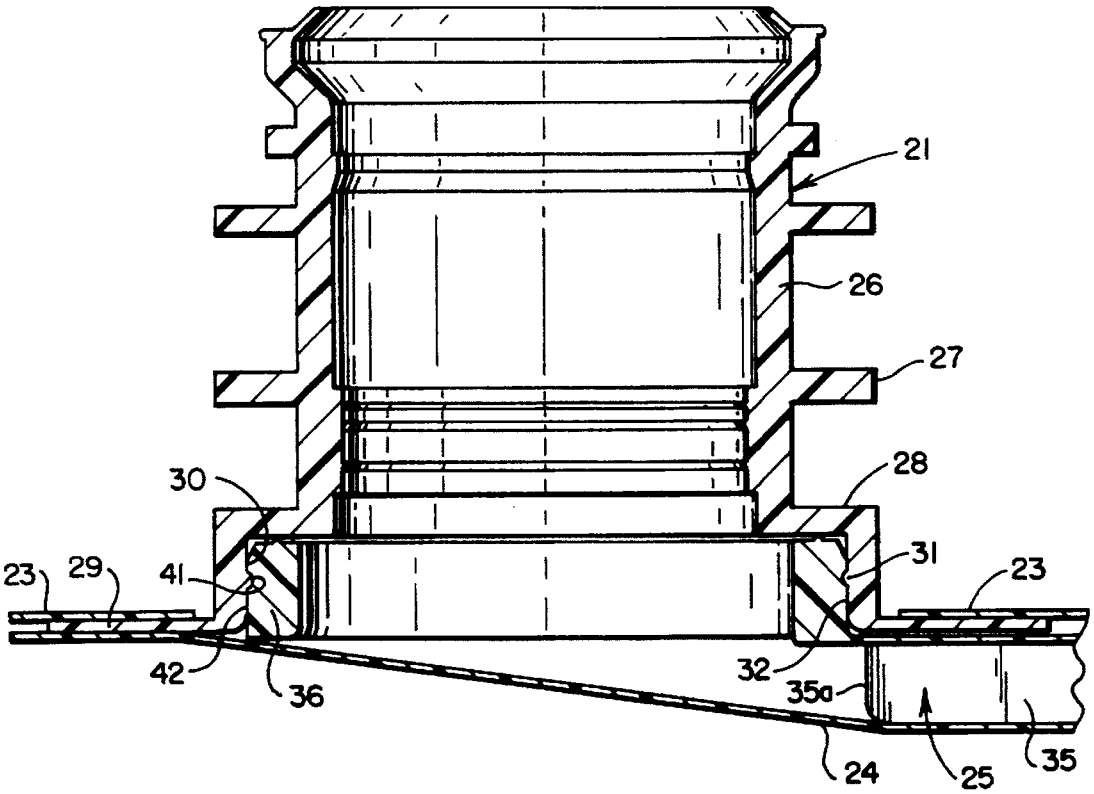

COLLAPSED BAG WITH EVACUATION CHANNEL FORM UNIT

BACKGROUND OF THE INVENTION AND PRIOR ART

This invention relates to a collapsed plastic bag with a form insert which is connected to the spout thereof so that it will extend into the filled bag and as its contents are withdrawn by a pressure differential on the bag, the bag will gradually collapse around the form to maintain an outlet passage to the spout until the bag is completely emptied.

A form of this general type is disclosed in U.S. Pat. No. 4,137,930 and merely consists of a perforated tube attached to the closure valve and about which the bag collapses. Another form of this general type is disclosed in U.S. Pat. No. 4,138,036 and consists of a flexible helical coil-adapter attached to the spout and about which the bag collapses to form a tubular passageway. Still another form of this general type is disclosed in U.S. Pat. No. 4,286,636 as consisting of a dip tube which is attached to the closure valve and which has longitudinal slots in the peripheral surface thereof leading into straight passages. With each of these forms, it is not possible to preinsert them into the bag before filling. It is necessary to first fill the bags and then the closure/valve with the dip tube attachment must be carefully inserted after fill. Doing so at a reasonable rate, without making a mess and without excessive labor costs is impossible. Also, introduction of unwanted air into the bag will occur.

SUMMARY OF THE INVENTION

The passage-producing unit of this invention, about which the walls of the container or bag collapse as the bag is emptied, comprises an elongated open-face multi-channel form and an integral mounting ring hingedly attached to one end thereof and adapted to be used to mount the form on the bag spout. The evacuation form unit consisting of the open-face channel and mounting ring is positioned flat within the bag and attached to the spout during the manufacture of the bag. The entire multi-channel form unit is preferably molded of plastic in one piece. The invention also includes a simple manufacturing method for providing the bag with the open channel form of the unit disposed flat between the opposed walls thereof and attached to the spout thereof.

BRIEF DESCRIPTION OF THE DRAWINGS

The best mode contemplated in carrying out this invention is illustrated in the accompanying drawings in which:

FIG. 1 is a perspective view of a flexible bag with the evacuation channel form unit of this invention disposed therein and attached to the spout thereof;

FIG. 2 is an enlarged sectional view taken along line 2—2 of FIG. 1;

DETAILED DESCRIPTION OF THE INVENTION

Figure 3:
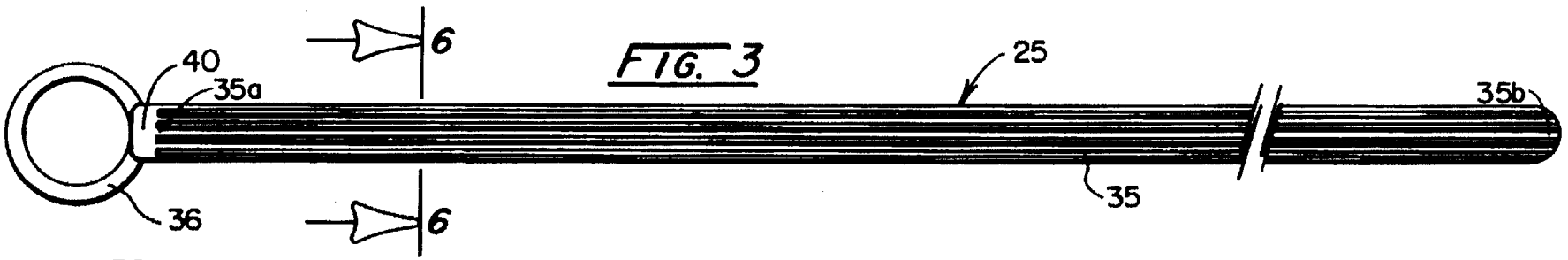
FIG. 3 is a plan view of the evacuation channel form and attaching ring of this invention.
Figure 4:
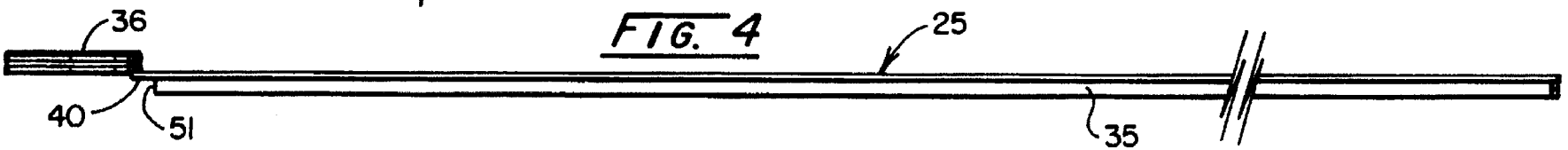
FIG. 4 is a side edge view of the unit of FIG. 1.
Figure 5:
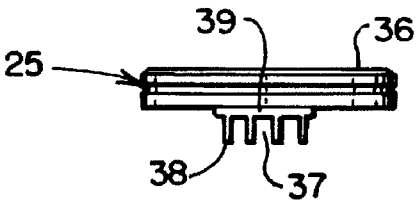
FIG. 5 is an end view of the ring end of the unit.
Figure 6:
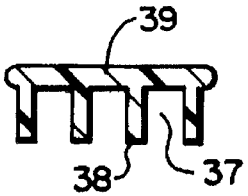
FIG. 6 is an enlarged transverse sectional view taken along line 6—6 of FIG. 3.

With specific reference to the drawings, there is illustrated in FIG. 1, a plastic bag 20 shown in its original manufactured, substantially flat collapsed form with a fitment in the form of a spout 21 extending from a side wall thereof near one end. The bag as manufactured is of flat rectangular form with a heat seal seam 22 along all its edges. The evacuation channel form unit 25 of this invention is inserted in the bag during manufacture and lies flat between the opposed superimposed flat walls 23 and 24 of the bag, as indicated in FIGS. 1 and 2, which may be of single or multiple ply.

The spout 21 is molded of semi-rigid plastic and may take various forms but will include a tubular body 26 through which the bag 20 is usually filled and emptied. It is formed to receive a dispensing valve and closure and is provided with means for mounting it on a wall of a box B as indicated in FIG. 8A, the flanges 27 and 28 being provided for this purpose in this particular spout. The flange 28 is spaced axially-outwardly from the large peripheral attaching flange 29 at its inner extremity which is heat-sealed to the upper wall 23 of the bag. Between the flanges 28 and 29 a cylindrical inwardly-opening ring-receiving socket 30 is formed which has an internal annual locking rib 31 on its inner annular wall surface 32.

The insert evacuation channel form unit 25 is shown best in FIGS. 3 to 6 and is an integral structure, preferably molded from plastic. It consists of two main sections, namely, an elongated channel form section 35 and a hingedly connected spout-mounting or attaching ring section 36. The channel form section is of flat multi-channel form with all the channels 37 open at both ends **35*a* and 35*b* and facing outwardly, being formed by the parallel longitudinally-extending ribs 38 projecting from a flat wall 39. However, the ribs and flat wall 39 are sufficiently flexible to permit flexing of the form-section 35 in a direction perpendicular to the normal flat plane of the wall 39**.

The ring 36 is integrally joined to one end of the form section 35 by an integral hinge tab 40, which spaces end **35*a* from the ring. The ring 36 and form section 35 are molded in substantially the same plane with section 35 extending radially from the ring, but the hinge 40 permits the section 35 to swing to various angles relative to the ring out of the plane of the ring. The ring is so formed that its peripheral outer surface 42 can fit interlockingly within the inner annular surface 32 of the spout socket 30 and it has an annular groove 41 on that surface which will receive the annular locking rib 31** on the socket wall surface.

Figure 7:
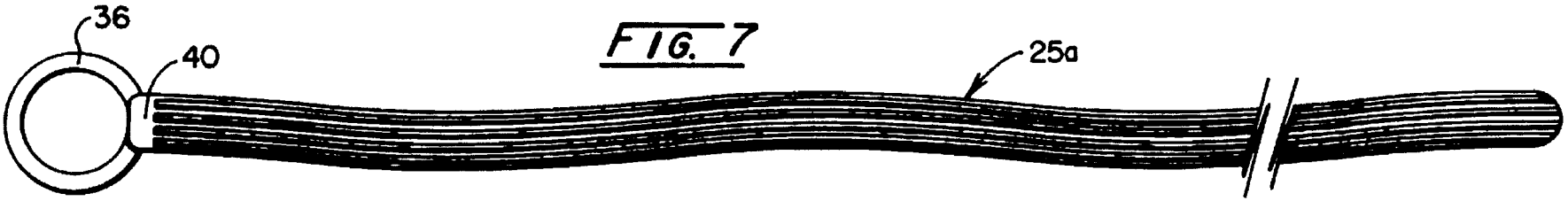
FIG. 7 is a plan view of a modification of the evacuation channel form.

In FIG. 7 there is shown a device **25*a* which is identical with that shown in FIG. 3** except that it has a sinuousoidal curve laterally which will give it more lateral stability.

With the unit 25 inserted in the bag 20 as indicated in FIG. 1 and 2 and the ring 36 mounted on the spout 21, the mounting or connecting ring 36 will have been snapped into position within the spout socket 30 and will be locked in that position by the spout annular rib 31 and cooperating groove 41. The form section 35 will extend with its lower end 35*b* near the bottom seam 22*a* of the bag. Then if the bag is filled, for example through the spout with the unit 25 in place, it is placed into a box B (FIG. 8) for storing and shipping. When put in use the spout 21 is mounted on the box B, as shown in FIG. 8A, and the form section 35 will extend into the bag 20. The box is shown in FIG. 8A on its side but may be upright, or in any other position. In either case, the form section 35 will flex at hinge 40 relative to the spout-mounting ring 36 and in itself and be long enough to extend to the farthest point in the box. As the contents of the bag is withdrawn, the bag will collapse from its spout end inwardly around the multi-channel form 35 to produce multiple passages to the spout 21 when the spout is positioned above the liquid level.

The spout my be controlled by various dispensing valves in association with various evacuation systems commonly known and used. In the example shown in FIGS. 8A and 9, the spout 21 has mounted thereon but not limited to an evacuation system of the type disclosed in U.S. Pat. No. 4,421,146 consisting of a separable service line connector 45, connected to a pump or other evacuator, which has an axially reciprocable probe 46 mounted thereon cooperating with a dispensing valve unit 47 mounted on the spout 21. As disclosed in the patent, axial movement of the probe will move the slide valve member 48 to open or close the radial outlets 49 thereof. In exposing the outlets 49 in the inward position of the slide valve member 48, an inwardly projecting annular skirt 50 on the inner end thereof engages the bag wall 24 as it collapses at the inner end of the spout. This will insure exposure of the outer open end 35*a* of the channel form 35 and maintain clear passage through the ring 36 to the exposed outlets 49. It will be noted that the ring 36 is of sufficient diamter to permit the skirt 50 to pass axially therethrough. Thus passageways will always be maintained through the collapsed part of the bag by the multi-channel form section 35 and by skirt 50 to the ring 36 and the associated radial outlets 49, as indicated in FIG. 9. Other types of closure valves and spouts in common use today may be modified to function in the same manner in combination with the evacuation form unit 25.

Figure 10:
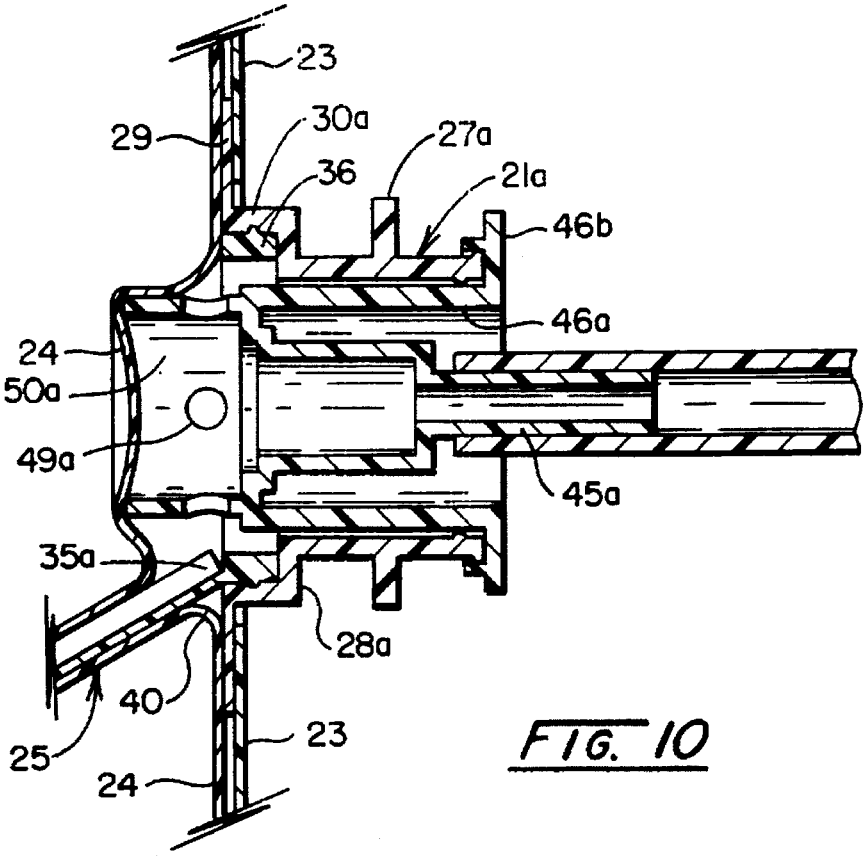
FIG. 10 is a similar view showing a different type of service-line connector on the spout.

FIG. 10 illustrates the evacuation unit 25 of this invention used with a different type of spout and evacuation system. The spout 21*a* is of tubular form and is attached to the bag 20 in a similar manner. It includes the inwardly-opening socket 30*a* for receiving the mounting ring 36 and similar axially-spaced external flanges 27*a* and 28*a* for mounting the spout in the wall of a box. After filling, the spout receives a closure (not shown) which remains sealed to the spout during storage and shipping. When put into use, the closure is removed and the evacuation system is connected and may include a plug-in service-line connector which will be connected to a pump or other suitable evacuator by tubing connected to tube outlet 45*a*. It includes a tubular adaptor 46*a* which is inserted in the spout 21*a* and is frictionally retained therein. At the inner side of the adaptor 46*a* is an inwardly-projecting skirt 50*a* having radial outlets 49*a* leading to outlet tube 45*a*. When the adaptor 46*a* is inserted in the spout 21*a* as determined by flange 46*b* and associated retaining means, its inner end will project axially into the ring 36 and its sleeve 50*a* will project even farther. This will hold the bag wall 24 away from the ends of the evacuation channels 37 at form end 35*a* to ensure that the contents can flow from the channels through the outlets 49*a* to tube outlet 45*a*. Thus, all contents of the bag 20 can be evacuated.

Figure 11:
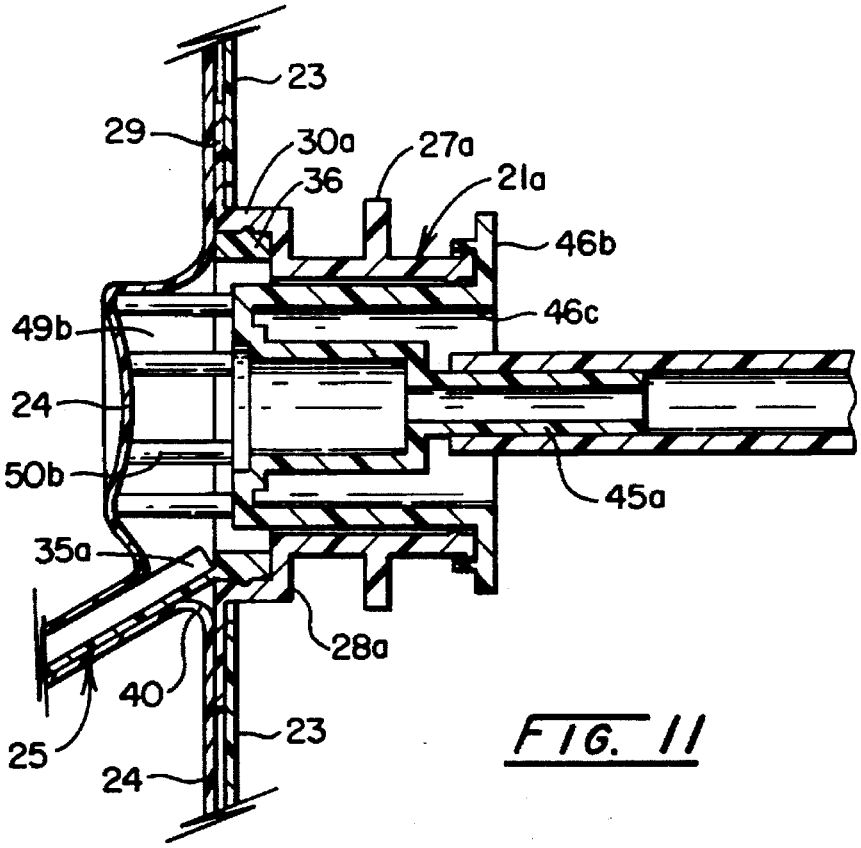
FIG. 11 is another similar view showing still another form of service line connector on the spout.

In FIG. 11, the spout 21*a* is identical with that shown in FIG. 10. The adaptor 46*c* is the same except that it has the inwardly-projecting, angularly-spaced pins 50*b* at its inner end with spaces 49*b* therebetween. The pins 50*b* like the skirt 50*a* will hold the bag wall 24 inwardly away from ring 36 and the ends of the channels at end 35*a*. Thus, the bag contents will flow from the channel passageways through the spaces 49*b* between the pins and to the tube outlet 45*a*.

It should be understood that many other different types of spouts and connecting systems could be used.

Figure 12:
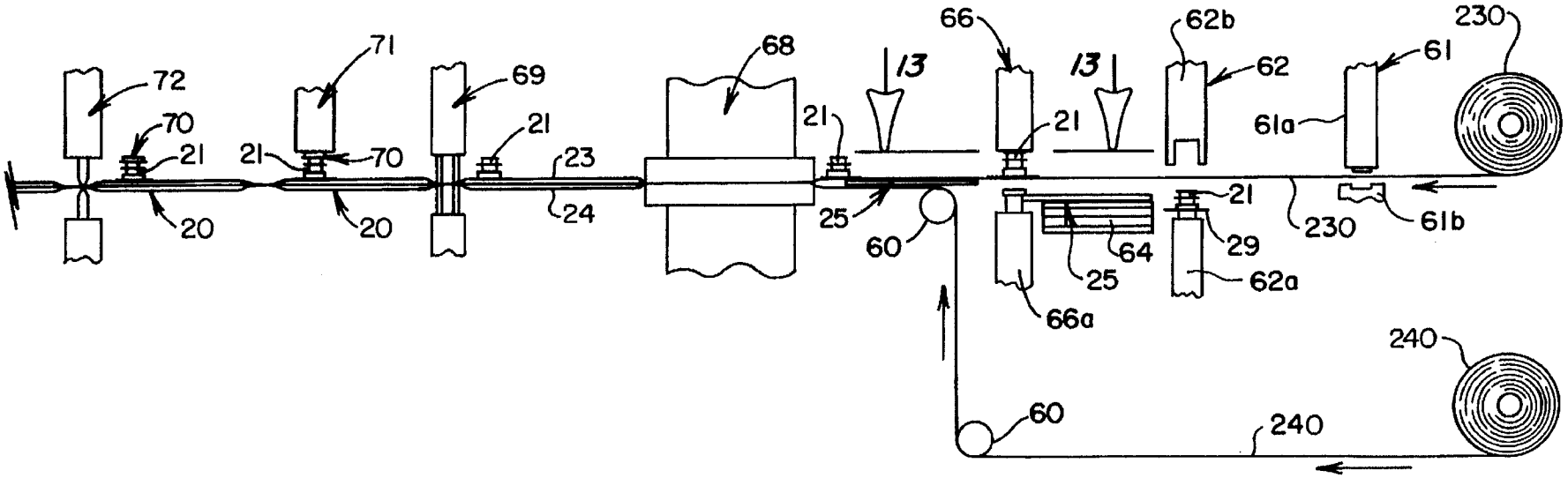
FIG. 12 is a schematic sectional view illustrating the steps of manufacturing flexible bags with the evacuation channels of this invention disposed therein and attached to the spouts thereof.
Figure 13:
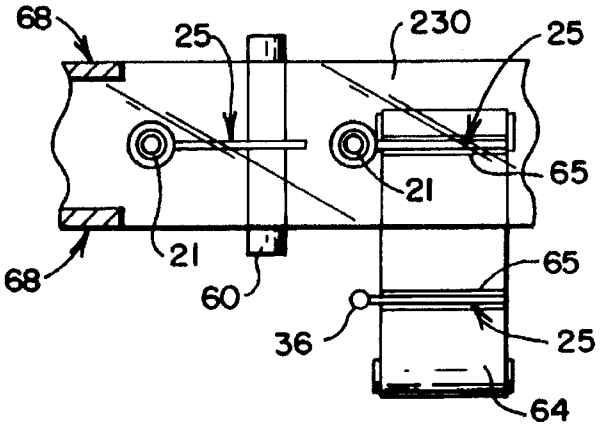
FIG. 13 is a plan view taken on line 13—13 of FIG. 12.

In FIGS. 12 and 13, a preferred method of forming the bag 20 with the evacuation channel form unit 25 inserted therein to the condition shown in FIG. 1 is schematically shown. The bag is formed from plies of suitable plastic or other material as is well known in the art. For sake of simplicity, a roll 230 of single ply material is shown for forming the upper wall 23 and a roll 240 is shown for forming the lower wall 24. The web 230 is pulled intermittently horizontally from the roll at an upper location above the web 240, which is pulled intermittently horizontally from the roll and then vertically around a lower guide roll 60 to an upper guide roll 60 where it is directed horizontally closely beneath the horizontally moving web 230. The web 230, after being pulled under tension from its roll, is subjected first to a punch unit 61 of a common type which is actuated to punch a spout-receiving hole in the web. This unit is provided with a fixed upper punch 61*a* above the web and a vertically movable die 61*b* below the web. The web 230 moves to the next unit 62 which is of a common type and which inserts the spout 21 into the receiving hole formed in the web. This unit includes a cylinder and piston unit 62*a* which supports a spout 21 to move it upwardly into the hole and an upper fixed heating element 62*b* which heat seals the flange 29 of the spout to the web 230 at the edge of the punched opening. Next the evacuation channel form units 25 are moved beneath the web 230 to a position at its longitudinal centerline. This is accomplished with a support conveyor 64 which is disposed transversely of the path of web 230 and the upper run of the belt is directly below that path. This conveyor has regularly-spaced transverse sockets 65 for receiving the units 25 when on the upper run with their rings 36 positioned forwardly of the edge of the conveyor in alignment with the spouts 21 moved into ring-receiving position. When a ring 36 of a unit 25 is in position beneath the spout 21, it is inserted therein by unit 66 which includes a plunger on the end of a lower cylinder and piston unit 66*a* which moves upwardly to engage the ring 36 and push it up into the downwardly-opening socket 30 of the cooperating spout 21 which, at that time, is supported from above by a fixed depending spout support. The two webs 230 and 240, with the unit 25 inserted therebetween, are carried on to a heat sealing unit 68 of a common type which heat seals the sides of the bag being formed in the usual manner and then farther on to a common heat-sealing unit 69 which heat seals the opposite ends of succeeding bags being formed. At this time, the completed bags are connected in a strip and may be supplied in that form with a closure or valve 70 positioned on each spout by a capping unit 71 of a common type if desired. The strip of bags may first pass to a perforating unit 72 of a common type or if the bags are to be supplied individually this may be a separating unit of a common type.

The movement of the webs 230 and 240, of the conveyor 64, and operation of the units 61, 62, 66, 68, 69, 71 and 72 may all be synchronized by the usual means.

It will be apparent from the above that this method provides a simple arrangement for forming the bags 20 with the evacuation channel form units 25 positioned flat therein between the front and rear walls 23 and 24 so that the flat bags 20 can be folded near the perforation or stacked if they are in individual form.

The bags supplied as separate bags or as a strip of bags with the inserted evacuation channel forms therein can be filled by the usual automatic or semi-automatic filling machine. When filled and disposed in a box, the evacuation channel form will extend to the point in the box farthest from the spout whether the box is upright or on its side. As the bag is evacuated and collapses, it will collapse around the multi-channel evacuation form which will produce passages to the spout. The mounting ring for mounting the channel form on the spout will not interfere with movement of dispensing valves or connector parts inwardly through the spout into the bag.

Having thus described the invention, what is claimed is:

1. A method of producing collapsed bags having spouts with form unit inserts connected therein and about which the bags collapse as they are emptied which comprises, for each bag, providing a form unit insert connected to a spout, said insert including an elongated form extending outwardly from the periphery of said spout, joining two opposed webs of material to produce opposed walls of the bag, and before joining the webs applying a spout to one of the webs and the insert to the spout so that the insert will be disposed between said opposed walls of the completed bag.

2. The method of claim 1 in which the spout is first sealed to one web, the form unit then affixed to the spout and then the webs are sealed to produce the bag.

3. The method of claim 1 which comprises feeding the two webs in separate planes to a location where they are joined and while separated applying a spout to one of the webs and the form unit to the spout, and then joining the webs at their edges and at transverse intervals to form the completed bag.

4. The method of claim 3 in which the webs are plastic and are fed simultaneously in superimposed relationship with the upper web first being subjected to a punch unit which punches a spout-receiving hole therein, then to a spout-supplying unit which inserts a plastic spout upwardly into the punched opening and heat sealing it therein and then to an insertion unit which inserts a ring of the plastic form unit upwardly into the receiving socket at the lower end of the spout, and then contacting the webs in superimposed relationship and heat-sealing them along the edges and longitudinally-spaced transverse intervals to form the completed bag.

5. The method of claim 4 including feeding a plurality of the form units by a conveyor transverse of the path of movement of the webs so that the successive rings thereof will align with the successive spouts at the insertion unit.

6. The method of producing collapsed bags having spouts with evacuation form unit inserts connected therein which comprises, for each bag, providing an insert with an elongated form upon which the bag can collapse as it is evacuated which has at least one continuous longitudinal open passage along its length and has means at one end for mechanically interfitting with cooperating means on the spout to connect it thereto so that it extends radially from the spout, joining two opposed webs of material to produce opposed walls of the bag, and before joining the webs applying a spout to one of the webs and mechanically interfitting an end of the form with the cooperating means on the spout so that the form will extend between said opposed walls of the completed bag.

7. The method of producing collapsed bags having spouts with evacuation form unit inserts connected therein which comprises, for each bag, providing an insert with an elongated form upon which the bag can collapse as it is evacuated which has at least one continuous longitudinal open passage along its length and has an inner open end, joining two opposed webs of material to produce opposed walls of the bag, and before joining the webs applying a spout to one of the webs extending outwardly therefrom and with its inner end open and flexibly securing the form, with its inner end in liquid communication with the spout and extending transversely therefrom to lie flat between said opposed webs so that as each completed bag is filled with liquid the form will swing into the liquid and the bag will collapse around it as it is evacuated.

8. A substantially flat collapsed bag with a form insert unit disposed therein, said bag comprising opposed superimposed substantially flat walls having a spout extending outwardly from one of the walls adjacent an end of the bag, said form insert unit comprising an elongated form connected to the spout and being of channel shape to direct the bag contents thereto when the filled bag is evacuated and collapses therearound, said form unit also including a connecting ring which connects with the spout and to which the elongated channel form is flexibly attached, said elongated channel form having a plurality of channels disposed side-by-side and opening outwardly, said elongated channel form including a flat flexible wall with parallel ribs extending from one face thereof to provide said plurality of channels, one end of the flat wall being connected to the ring by a flexible hinge.

9. A bag according to claim 8 in which the flat wall extends radially from the ring.

10. A bag according to claim 9 in which the ribs on the flat wall terminate just short of the ring.

11. A bag according to claim 10 in which the ring fits into a socket at the inner end of the spout.

12. A bag according to claim 11 including cooperating retaining rib and groove means between the ring and spout socket to hold the ring in the socket.

13. A bag according to claim 9 in which the elongated channel form has a sinousoidal curve laterally.

14. A collapsible container having a spout extending outwardly therefrom, said spout having a socket at its inner end, a form unit connected to an inner portion of the spout and extending into the container and about which the container will collapse as its contents is removed through the spout, said form unit comprising a connecting ring connecting with the spout and an elongated form of channel shape flexibly connected to the ring, said spout having a tubular passage and said ring fitting into the socket to be eccentric therewith, and means for retaining the ring in the socket, said ring being of larger diameter than the tubular spout passage so that a dispensing member mounted therein can extend axially through the ring.

15. The combination of claim 14 including a dispensing control member movable inwardly in the spout to a position where it will project beyond the ring.

16. The combination of claim 15 in which the elongated form comprises a flat elongated wall with a plurality of parallel ribs on one face to form a plurality of channels, said flat wall being connected by a flexible hinge to the ring at one of its ends, said ribs terminating short of said hinge.

17. A collapsible container according to claim 14 in which the elongated channel shape form has a plurality of channels extending along one of its faces.

18. A collapsible container according to claim 17 in which the channel shape form comprises a flat elongated flexible wall with a series of channel-forming ribs extending along one face thereof.

19. A collapsible container according to claim 18 in which the spout has axially-spaced exterior peripheral flanges.

20. A collapsible container according to claim 18 in which the flat wall extends radially from the ring and is connected thereto by a flexible hinge, said ribs terminating short of the hinge.

21. A form unit for insertion into a collapsible container having a spout so that as the filled container is emptied the walls of the container can collapse around it, said form unit comprising a ring for mounting the unit on the spout and an elongated channel form flexibly connected to the ring, said elongated form comprising a flat elongated wall connected radially to the ring by a flexible hinge, a plurality of parallel ribs disposed along one face of the wall to form multiple channels, said ribs terminating short of the hinge.

22. In a collapsible container for liquids comprising two superposed sheets of liquid-impervious flexible material joined in liquid-tight connection about their peripheries, a tubular spout extending outwardly from one of the sheets, and an evacuation unit extending from said spout into the remote reaches of the interior of the container in the form of an elongated member having at least one continuous longitudinal passage capable of communicating along its length with a body of liquid in the container and being capable of maintaining the integrity of said passage from the liquid body to the spout as the container walls collapse about said member by the evacuation of the liquid contents, the improvement comprising an attaching ring flexibly connected to said elongated member at one end of said member and secured to the spout, said flexible connection enabling said elongated member to extend transversely from the spout to lie flat between the superposed sheets before the container is filled, and to swing flexibly therefrom into the body of liquid when the container is filled.

23. A substantially flat collapsed bag for liquids comprising opposed substantially flat walls having a spout extending outwardly from one of the walls, an evacuation unit extending from said spout into the remote reaches of the interior of the bag in the form of an elongated form member having at least one continuous longitudinal passage capable of communicating along its length with a body of liquid supplied in the bag and being capable of maintaining the integrity of said passage from the liquid body to the spout as the bag walls collapse about said member by the evacuation of the liquid; the improvement comprising an attaching member flexibly connected to said elongated form member at one end of said member and secured to the spout, said spout having cooperating means thereon for mechanically interfitting with said attaching member to enable said elongated member to extend transversely from the spout so as to lie flat between the opposed walls before the bag is filled and to swing flexibly therefrom into the body of liquid when the bag is filled.

24. A substantially flat collapsed bag for liquids comprising opposed substantially flat walls having a spout extending outwardly from one of the walls, an evacuation unit extending from said spout into the remote reaches of the interior of the bag in the form of an elongated form member having at least one continuous longitudinal passage with an inner end connected to the spout and capable of communicating along its length with a body of liquid supplied in the bag and being capable of maintaining the integrity of said passage from the liquid body to the spout as the bag walls collapse about said member by the evacuation of the liquid; the improvement comprising said elongated form member being attached at said inner end of said member in liquid communication with said spout so that said elongated member extends transversely from the spout and lies flat between the opposed walls before the bag is filled and to enable it to swing therefrom into the body of liquid when the bag is filled.

25. In a collapsible container for liquids comprising two superposed substantially flat walls of liquid-impervious flexible material joined in liquid-tight connection about their peripheries, a spout extending outwardly from one of the walls and an evacuation unit extending from said spout into the remote reaches of the interior of the container in the form of an elongated form member having at least one continuous longitudinal passage capable of communicating along its length with a body of liquid in the container and being capable of maintaining the integrity of said passage from the liquid body to the spout as the container walls collapse about said member by the evacuation of the liquid contents; the improvement comprising an attaching member flexibly connected to said elongated member at one end of said member and secured to the spout, said spout having cooperating means thereon for mechanically interfitting with said attaching member to enable said elongated member to extend transversely from the spout so as to lie flat between the superposed sheets before the container is filled and to swing flexibly therefrom into the body of liquid when the container is filled.

26. A substantially flat collapsed bag for liquids comprising, said bag including opposed substantially flat walls having a spout extending outwardly from one of the walls, an evacuation unit extending from said spout into the remote reaches of the interior of the bag, said evacuation unit including an elongated member having at least one continuous longitudinal passage with an inner end, said inner end being connected to the spout, said elongated member being configured along its length to communicate with a body of liquid supplied in the bag, said elongated member being configured to maintain the integrity of said passage from the liquid body to the spout as the bag walls collapse about said member by the evacuation of the liquid;

the improvement comprising means for attaching said elongated member in liquid communication with said spout so that said elongated member extends transversely from the spout and lies flat between the opposed walls before the bag is filled and to enable said member to swing into the body of liquid when the bag is filled.

27. A disposable liquid containing and dispensing package comprising:

(a) a flexible bag adapted to be filled with a liquid to be dispensed therefrom;

(b) said bag including a spout having an opening through which said bag can be filled and emptied;

(c) a flat dip strip located inside of said bag and being in liquid flow communication with said opening of said spout for aiding the withdrawal of liquid from said bag and for providing a liquid passage out of said bag as said bag progressively collapses when the liquid is dispensed, said flat dip strip including a plurality of interior passages, said passages extending parallel both (1) to each other and (2) to the longitudinal direction of said flat dip strip, said passages extending substantially the entire length of said flat dip strip;

(d) said flat dip strip being attached to said spout such that said passages are in liquid communication with said spout opening; and (e) said flat dip strip including a portion extending across said spout opening and being attached to said spout at said opening and adjacent an end of said dip strip.

* * * * *

UNITED STATES PATENT AND TRADEMARK OFFICE

CERTIFICATE OF CORRECTION

PATENT NO. : 5,647,511

DATED : Jul. 15, 1997

INVENTOR(S) : Curtis J. Bond

Figure 8:
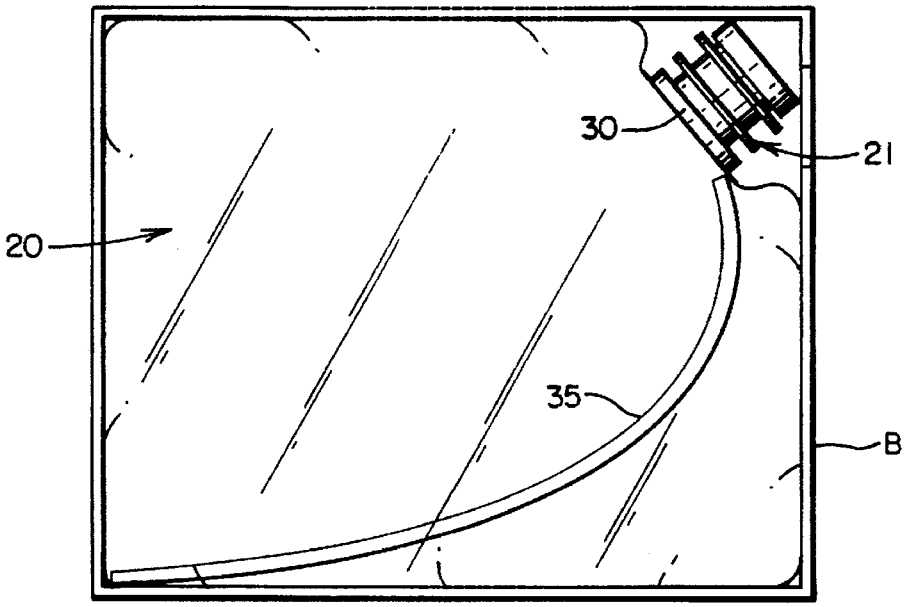
FIG. 8 is a schematic view showing the evacuation channel form unit in a filled bag in a box before use.
Figure 8A:
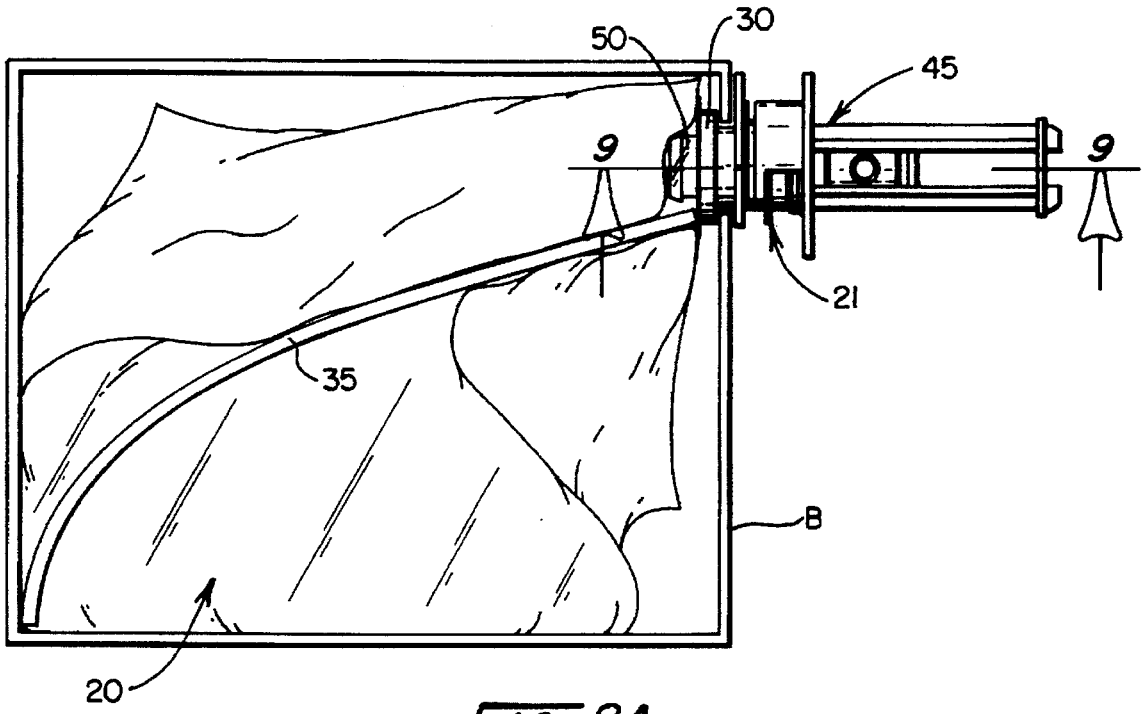
FIG. 8A is a schematic view showing the evacuation channel form attached to the spout of a partially-collapsed bag in a box being evacuated through a valve mounted in the spout.
Figure 9:
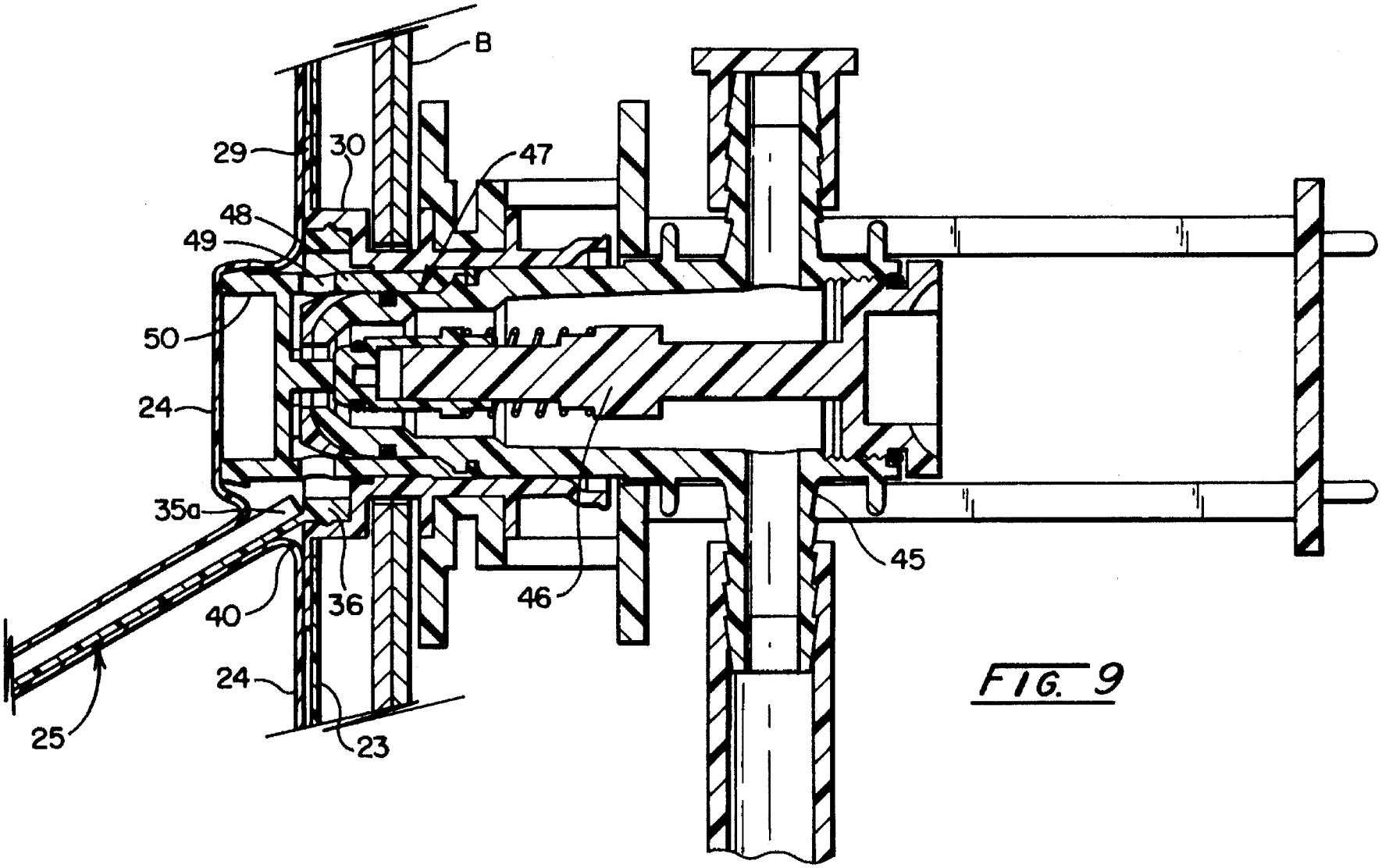
FIG. 9 is an enlarged sectional view taken along line 9—9 of FIG. 8; showing one type of service line connector for evacuating the bag.

It is certified that error appears in the above-indentified patent and that said Letters Patent is hereby corrected as shown below:

Column 2, line 53, after "39" insert --as illustrated in Figs. 8 and 8A showing the ability of the evacuation channel 25 to swing into the liquid--. Claim 14, line 11, delete "eccentric" and insert therefor --concentric--. Claim 26, line 16, delete "means for attaching"; line 17, after "member" insert --being attached--.

Signed and Sealed this

Fourth Day of November, 1997

*Attest:*

*Attesting Officer*

BRUCE LEHMAN

*Commissioner of Patents and Trademarks*